US010265749B2

(12) United States Patent
Del Fabro

(10) Patent No.: US 10,265,749 B2
(45) Date of Patent: Apr. 23, 2019

(54) MACHINE FOR BENDING METAL PRODUCTS AND CORRESPONDING BENDING METHOD

(71) Applicant: M.E.P. MACCHINE ELETTRONICHE PIEGATRICI SPA, Reana del Rojale (IT)

(72) Inventor: Giorgio Del Fabro, Udine (IT)

(73) Assignee: M.E.P. MACCHINE ELETTRONICHE PIEGATRICI SPA, Reana del Rojale (IT)

( * ) Notice: Subject to any disclaimer, the term of this patent is extended or adjusted under 35 U.S.C. 154(b) by 546 days.

(21) Appl. No.: 14/892,132

(22) PCT Filed: May 20, 2014

(86) PCT No.: PCT/IB2014/061552
§ 371 (c)(1),
(2) Date: Nov. 18, 2015

(87) PCT Pub. No.: WO2014/188332
PCT Pub. Date: Nov. 27, 2014

(65) Prior Publication Data

US 2016/0107217 A1 Apr. 21, 2016

(30) Foreign Application Priority Data

May 20, 2013 (IT) ..... UD2013A0066

(51) Int. Cl.
*B21D 11/12* (2006.01)
*B21D 35/00* (2006.01)
*B21D 7/022* (2006.01)

(52) U.S. Cl.
CPC ..... *B21D 7/022* (2013.01); *B21D 11/12* (2013.01); *B21D 35/002* (2013.01)

(58) Field of Classification Search
CPC ..... B21D 7/02; B21D 7/022; B21D 7/024; B21D 7/025; B21D 43/285; B21D 11/12
See application file for complete search history.

(56) References Cited

U.S. PATENT DOCUMENTS 468,584 A * 2/1892 Symonds ..... B21D 7/063 140/102
2,424,024 A * 7/1947 Garton ..... B21D 7/022 72/338

(Continued)

FOREIGN PATENT DOCUMENTS

EP 1415734 5/2004
JP 2000233234 A * 8/2000

(Continued)

OTHER PUBLICATIONS

Machine Translation of WO2012/130350, Translated Jan. 31, 2018, 7 Pages.*

(Continued)

*Primary Examiner* — Teresa M Ekiert
*Assistant Examiner* — Gregory D Swiatocha
(74) *Attorney, Agent, or Firm* — Hamre, Schumann, Mueller & Larson, P.C.

(57) ABSTRACT

Machine for bending metal products, wherein the machine includes a drawing unit configured to feed at least one metal product along an axis of feed and toward a bending unit and a shearing unit configured to shear the metal product. The bending unit is mounted on a translating platform able to be translated in a direction of translation transverse to the axis of feed, and at least one part of the shearing unit is mounted on the translating platform.

10 Claims, 3 Drawing Sheets

(56) References Cited

U.S. PATENT DOCUMENTS

| | | | | | |
|---|---|---|---|---|---|
| 4,248,273 | A * | 2/1981 | Marcello | B21D 11/12 | 140/105 |
| 4,993,253 | A * | 2/1991 | Del Fabro | B21D 7/12 | 72/217 |
| 5,628,224 | A * | 5/1997 | McClung | B21D 22/22 | 72/336 |
| 6,813,922 | B2 * | 11/2004 | Etienne | B21D 11/12 | 72/217 |
| 2012/0279274 | A1 * | 11/2012 | Del Fabro | B21D 11/12 | 72/372 |
| 2014/0000335 | A1 * | 1/2014 | Fries | B21D 7/024 | 72/362 |

FOREIGN PATENT DOCUMENTS

| | | | | |
|---|---|---|---|---|
| WO | 2003045603 | | 6/2003 | |
| WO | 2012143776 | | 10/2012 | |
| WO | WO 2012130350 | A1 * | 10/2012 | B21D 7/024 |

OTHER PUBLICATIONS

Machine Translation of JP2000-233234, Nishimura, Translated Jun. 13, 2018, 5 Pages.*

International Search Report, issued in the corresponding international PCT application No. PCT/IB2014/061552, dated Sep. 26, 2014, 3 pages.

* cited by examiner

MACHINE FOR BENDING METAL PRODUCTS AND CORRESPONDING BENDING METHOD

FIELD OF THE INVENTION

The present invention concerns a machine and corresponding method to bend metal products such as bars, reinforcement round pieces, section bars, pipes or other profiles with any section shape.

BACKGROUND OF THE INVENTION

Bending machines are known, for bending metal products, for example bars, reinforcement round pieces, section bars, pipes or other profiles with any section shape, for shaping stirrups or other shaped elements.

These machines normally consist of a main drawing unit, for example with rolls, which feeds the metal products toward a bending unit, and a shearing unit or shears, interposed between the main drawing unit and the bending unit, which shears the metal products to take them to the size corresponding to the linear development of the segments to be formed.

Since this linear development, or length of the initial metal product when working from segments of a predetermined length, often does not exactly correspond to the length of the sheared metal product or an exact sub-multiple thereof, a terminal segment or offcut remains between the main drawing unit and the shears, which must be removed before a new working cycle is started.

The shaped element still in the machine is no longer gripped in the main drawing unit and therefore it is no longer possible to control its movement, for example to restart the bending by making the metal product move back toward the drawing unit.

Furthermore, when they do not fall by themselves, the offcuts have to be discharged from the axis of feed of the metal product: this must be done manually or using suitable expulsion devices.

The manual solution often entails the need to stop the machine, to remove possible protections and to extract the segment, with obvious downtimes and problems in terms of safety for the operator.

There are also automated expulsion devices which intervene after the shearing so that the offcut is discharged, thus freeing the working axis of the shears and the main drawing unit. However these run the risk that the discharged offcut can interfere with the bending unit or other operating units that may be present on the bending machine, compromising its correct functioning and obliging the operator to intervene in any case.

Furthermore, this solution does not guarantee sufficient safety for the operator, because the offcuts are discharged in an uncontrolled way and can hit the operator.

Moreover, since the shearing unit is interposed between the drawing unit and the bending unit, once the bending operations have been carried out on the metal product being worked, the latter must be moved by the drawing unit in an inverse direction to the normal feed of the metal product, to dispose the segment to be sheared in correspondence with the shearing unit.

The movement of the metal product in the inverse direction entails an increase in the bending times, and in the case of terminal segments of the metal product, it is not always possible to command the movement thereof for the above reasons.

Another disadvantage is the quantity and length of the offcuts. In other words, discarding material to be removed from the work cycle also represents a considerable cost.

These disadvantages can lead to losses in productivity, even considerable ones, for example if the segment jams, or can lead to injury for the operator, for example where the segment goes to an anomalous and unsafe position.

One purpose of the present invention is to obtain a bending machine and a corresponding bending method able to limit the quantity and length of the offcuts to be discharged.

Another purpose of the present invention is to reduce the constructional and management complexity of the machine, reducing the moving parts thereof.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a machine for bending metal products comprises a drawing unit configured to feed at least one metal product along an axis of feed and toward a bending unit, and a shearing unit configured to shear the metal product. The bending unit is mounted on a translating platform in a direction of translation transverse to the axis of feed.

According to one aspect of the present invention at least one part of the shearing unit is mounted on the translating platform.

Disposing the shearing unit on the same translating platform on which the bending unit is mounted prevents the bulk of the shearing unit from being completely interposed between the drawing unit and the bending unit. This allows to move the latter nearer each other, considerably reducing the distance between them. A reduced distance prevents the problem of offcuts from the metal products becoming jammed in the machine, thus requiring the manual intervention of operators. It is therefore also possible to reduce the working scrap and avoid possible dangerous conditions for the operator.

It is also to be noted that the reduced distance between the drawing unit and the bending unit reduces to a minimum the length between the last segment of finished bent product and the portion which is sheared.

In substance the final side of the finished product is very limited and can be determined, for example, by the diameter of the contrast pin of the bending unit. The need to move the metal product in the opposite direction to the normal direction of feed is thus limited or totally eliminated.

In accordance with a possible form of embodiment of the present invention, the shearing unit comprises a fixed shearing part mounted on a component fixed with respect to the translating platform, and a mobile shearing part mounted on the translating platform. Making the translating platform translate, the mobile shearing part is moved with respect to the fixed shearing part and the cut is made. This solution exploits the same movement provided for the translating platform to carry out the shearing. In this way the constructional complexity of the machine is simplified since fewer actuation components are needed, and also the complexity of management is simplified.

One possible form of embodiment provides that the fixed support component of the fixed shearing part extends toward the translating platform, at least partly overlapping it. This solution allows to further reduce the distance between the drawing unit and the bending unit.

The present invention also concerns a method to bend metal products with a bending machine as described above.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
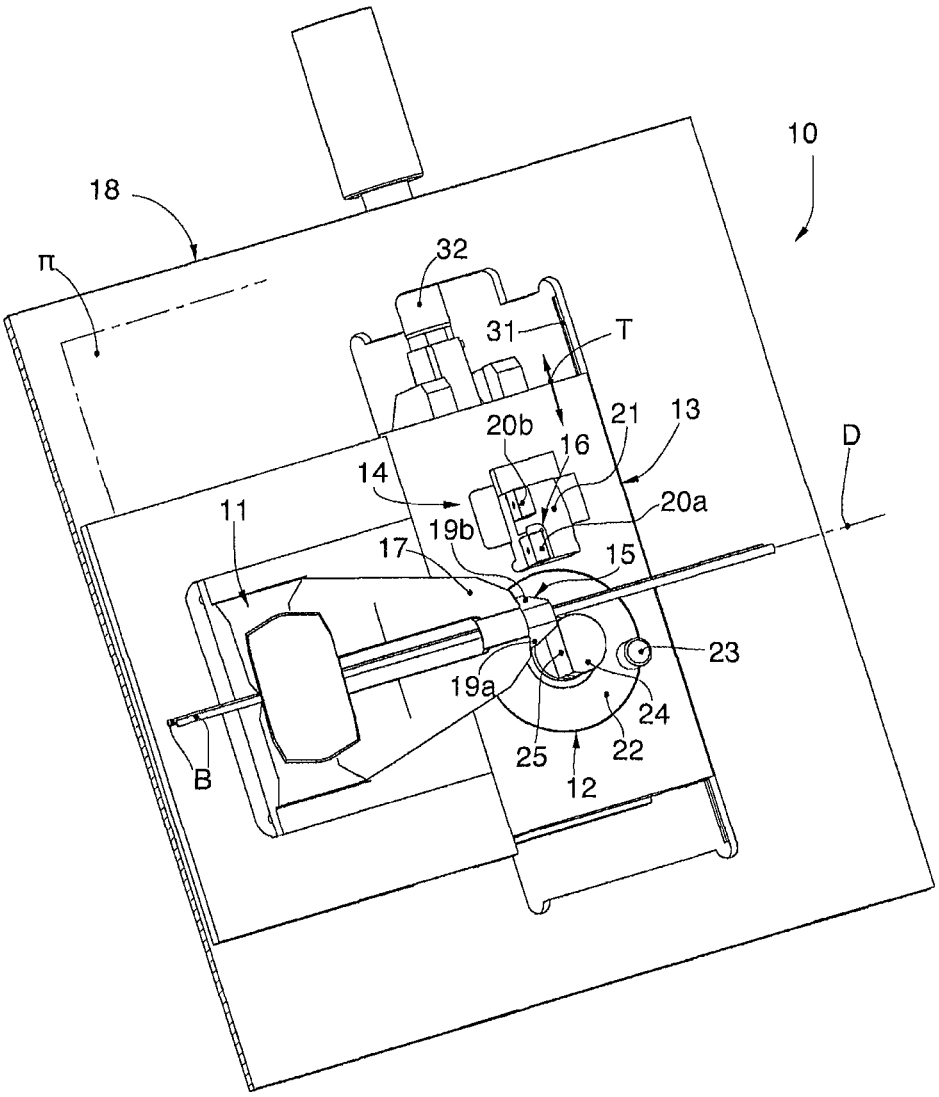
FIG. 1 is a schematic representation of a machine for bending metal products in accordance with a first form of embodiment.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME FORMS OF EMBODIMENT

With reference to FIG. 1 a bending machine 10 according to the present invention is shown schematically and partially, and is configured to bend at least one metal product, in this case two bars B, in order to make shaped elements, for example stirrups for making reinforcements.

The machine 10 according to the invention comprises a drawing unit 11, of the roll type for example, configured to feed the bars B along an axis of feed D and toward a bending unit 12 disposed downstream.

The bending unit 12 is mounted on a translating platform 13 configured to translate in a direction of translation T transverse to the axis of feed D.

In the form of embodiment shown in FIGS. 1-5 the direction of translation T is substantially orthogonal to the axis of feed D.

Implementations of the present invention provide that the direction of translation T and the axis of feed D lie on a plane $\pi$ which substantially corresponds to the bending plane of the bars B.

At least one part of a shearing unit 14 is mounted on the translating platform 13, and is disposed adjacent to the bending unit 12 laterally with respect to the axis of feed D of the bars B. In possible forms of embodiment it is possible to provide that at least one part of the shearing unit 14 is disposed adjacent to the bending unit 12 in a direction substantially coincident to the direction of translation T.

The translation of the translating platform 13 in the direction of translation T allows to bring the bending unit 12 or the shearing unit 14 into selective cooperation in order to bend or respectively to shear the bars B.

A first form of embodiment of the invention provides that the shearing unit 14 is completely mounted on the translating platform 13. Possible implementations of this form of embodiment provide that the shearing unit 14 is provided with its own actuation members for shearing the bars B.

Another form of embodiment provides that the shearing unit 14 comprises a fixed shearing part 15, mounted on a fixed component 17 of the machine 10, and a mobile shearing part 16 mounted on the translating platform 13. The translation of the translating platform 13 in the direction of translation T brings the fixed shearing part 15 into cooperation with the mobile shearing part 16 for the subsequent shearing of the bars B.

One possible form of embodiment provides that the fixed component 17 is attached to or part of a support frame 18 of the machine 10.

In possible implementations of the invention, the fixed component 17 extends from the support frame 18 toward the translating platform 13, at least partly overlapping the latter. This particular form of embodiment allows to dispose the drawing unit 11 in immediate proximity to the bending unit 12 with consequent reduction of the distance between them.

In the form of embodiment shown in FIG. 1, the fixed component 17 defines a containing and protection body for the drawing unit 11 disposed upstream.

The fixed shearing part 15 and/or the mobile shearing part 16 can comprise respective shearing blades 19*a* and 19*b*, and respectively 20*a* and 20*b*.

As shown in the form of embodiment in FIG. 1, the fixed shearing part 15 can comprise two shearing blades 19*a* and 19*b* disposed on one side and the other with respect to the bars B which are made to move along the axis of feed D.

The mobile shearing part 16 can also comprise two shearing blades 20*a* and 20*b* disposed on one side and the other of its support body 21.

The cooperation between the shearing blades 19*a* and 20*a* determines the shearing of the bars B by means of translation in a first direction of the translating platform 13. The translation of the translating platform 13 in a second direction, opposite to the first, determines the cooperation between the shearing blades 19*b* and 20*b*. This form of embodiment allows to execute the shearing on both one side and the other of the bars B.

Possible forms of embodiment of the present invention can provide that at least the mobile shearing part 16 of the shearing unit 14 can be translated in a direction orthogonal to the plane defined by the translating platform 13 to bring it into an active position in order to shear the bars B, and at least an inactive position, retracted from the plane defined by the translating platform 13. To this purpose the mobile shearing part 16 can be mounted on sliding guides located transverse to the direction of translation T and to the axis of feed D and actuation members can be associated thereto in order to determine its movement along the guides. In this way it is possible to avoid possible conditions of interference between the shearing unit 14 and the bars B when these are bent.

In the form of embodiment shown in FIGS. 1-5, the bending unit 12 comprises a rotating mandrel 22 substantially disc shaped and provided on its periphery with a bending pin 23 of a substantially cylindrical shape which extends orthogonal with respect to the rotating mandrel 22.

The bending unit 12 also comprises a contrast pin 24, solidly associated to the rotating mandrel 22 in proximity to its center of rotation and around which the bars B are bent.

Drive members are also associated to the rotating mandrel 22 in a known manner and configured to rotate the latter around its axis, taking the bending pin 23 into rotation with it.

Possible forms of embodiment of the invention provide that the bending unit 12 is associated to translation devices, not shown in the drawings and configured to translate the latter with respect to the bending plane $\pi$ of the bars B, making the bending unit 12 retracted with respect to the plane defined by the translating platform 13.

The translation of the translating platform 13 allows to position the contrast pin 24 substantially tangent to the bars B which are fed. In the case shown in FIG. 2 the contrast pin 24 is positioned under the bars B in order to make the bends downward. Similarly, positioning the contrast pin 24 above the bar B, it is possible to make the bends upward.

Other forms of embodiment can also provide other types of bending units, for example benders with a hoe-shaped pin.

Possible forms of embodiment, shown in FIG. 1 for example, provide that the contrast pin 24 has a substantially sectioned cylindrical configuration, that is, it is provided with a flat surface 25, facing during use toward the drawing unit 11. This form of embodiment allows to bring the drawing unit 11 even closer to the bending unit 12, reducing the distance.

Implementations of the invention can provide that the flat surface 25 of the contrast pin 24 is substantially aligned with and facing the fixed shearing part 15 of the shearing unit 14 so that, during the translation of the translating platform 13, the contrast pin 24 does not become interfering with the fixed shearing part 15 and is positioned substantially flush with the latter, thus reducing the distance between the drawing unit 11 and the bending unit 12.

In possible forms of embodiment, not shown in the drawings, the machine 10 can comprise a guide member configured to guide the translation of the bars B along the axis of feed D.

The translating platform 13 is mounted on sliding guides 31 which develop in a direction parallel to the direction of translation T.

The sliding guides 31 are mounted on a support plane that in practice defines the plane $\pi$ on which the bars B are bent.

Actuation members 32 are connected to the translating platform 13, configured to determine the selective translation of the translating platform 13 in the direction of translation T.

The actuation members 32 can be chosen from a group consisting of pneumatic actuators, oil-pressure actuators, electric actuators such as screw jacks, kinematic mechanisms or possible combinations thereof.

With reference to FIGS. 2-5 some forms of embodiment of a method for bending bars B according to the present invention are described.

Figure 2:
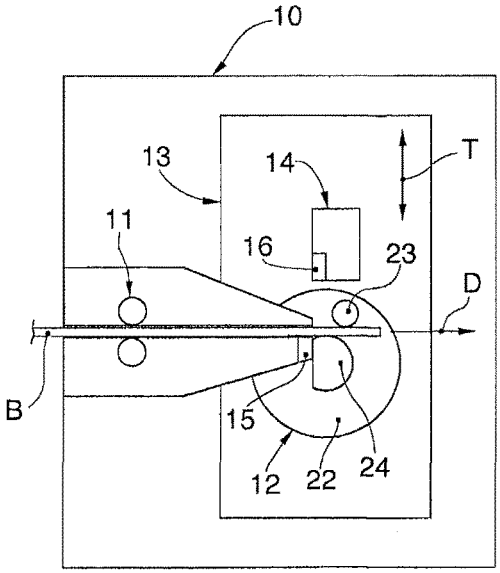
FIG. 2 is a schematic representation of the machine for bending metal products in FIG. 1, in a first operating condition.

In particular, the method provides to feed at least one bar B, in this case two bars B, by the drawing unit 11 along the axis of feed D and toward the bending unit 12 (FIG. 2).

The translating platform 13 is positioned so that the contrast pin 24 is located substantially tangent to the bars B which are fed.

The bending pin 23 is located on the side of the bars B according to which the bend must be made.

Figure 3:
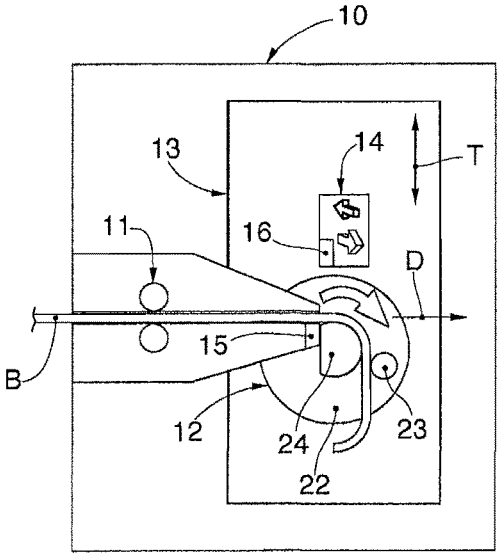
FIG. 3 is a schematic representation of the machine for bending metal products in FIG. 1, in a second operating condition.
Figure 4:
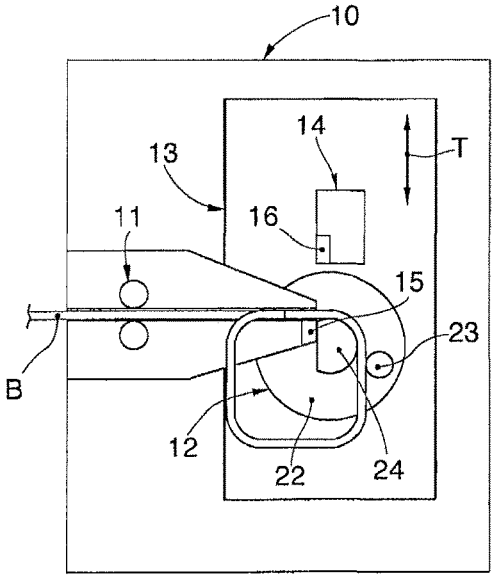
FIG. 4 is a schematic representation of the machine for bending metal products in FIG. 1, in a third operative condition.

The rotation of the rotating mandrel 22 determines the bending of the bars B around the contrast pin 24 due to the action of the bending pin 23 (FIG. 3).

By means of a coordinated sequence of feeding the bars B and making the bends, it is possible to determine the desired shape of the stirrup.

During the operations to feed and bend the bars B, at least a part of the shearing unit 14, in this case the mobile shearing part 16, is kept in its inactive position, retracted with respect to the translating platform 13 so that the bars B do not interfere with the bending unit 12.

Once the stirrup is defined, an operation is provided to shear the bars B in order to separate the stirrup.

The shearing operation provides to translate the translating platform 13 in the direction of translation T to bring the shearing unit 14 into cooperation with the bars B.

A first form of embodiment provides that the translation operation of the translating platform 13 determines the actuation of the shearing unit 14. In the form of embodiment shown in FIGS. 1 and 5 it is provided that the translation of the translating platform 13 brings the mobile shearing part 16 into cooperation with the fixed shearing part 15.

Forms of embodiment of the method according to the present invention can provide that during the translation of the translating platform 13, in order to take the shearing unit 14 into cooperation with the bars B to be sheared, the shearing unit 14, or at least part of it, passes from its inactive position to its active and protruding position, to carry out the shearing.

In the active position of the shearing unit 14, the fixed shearing part 15 and the mobile shearing part 16, or at least one of them, has its shearing blades 19*a*, 19*b* protruding from the translating platform 13 to a suitable height so that they do not cut into or shear the stirrup made. To this purpose some solutions can provide that the shearing blades 19*a*, 19*b*, 20*a*, 20*b* protrude from the translating platform 13 to a height equal to the diameter or diameters of the bars B.

During the shearing operations it can be provided that the bending unit 12 is taken into a retracted condition with respect to the translating platform 13 in order to allow the rapid discharge of the stirrup obtained. To this purpose it is possible to provide that the translating platform 13 is disposed, during use, with its plane substantially vertical or subvertical in order to discharge the stirrups by the effect of gravitation only.

The shearing operation does not make it necessary to move the bars B in the opposite direction to that of their normal feed in order to take the stirrup produced into correspondence with the shearing unit 14. This allows to reduce the work cycle time of the machines, giving the advantage of more efficient productivity.

It is clear that modifications and/or additions of parts may be made to the machine for bending metal products and corresponding bending method as described heretofore, without departing from the field and scope of the present invention.

Figure 6:
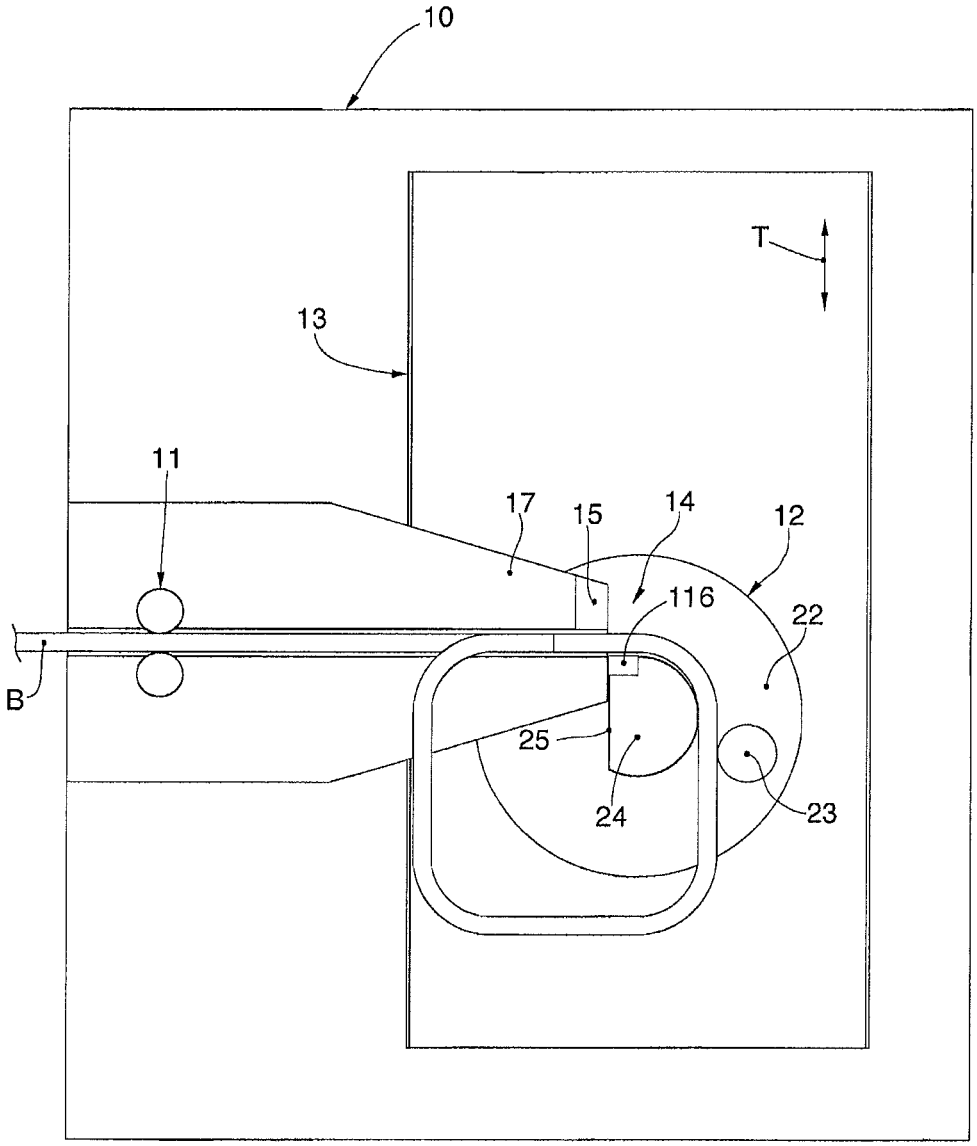
FIG. 6 is a plan schematic representation of a machine for bending metal products in accordance with a variant embodiment.

In other forms of embodiment, for example shown in FIG. 6, it is provided that the mobile shearing part, indicated here by the reference number 116, instead of being mounted on a support body separate from the bending unit 12, is associated to the latter, for example mounted on the rotating mandrel 22 at the side of the contrast pin 24. According to one solution of this form of embodiment, the mobile shearing part 116 is mounted and/or made closely adjacent to the contrast pin 24 and moves solidly with it.

In particular, some forms of embodiment of the invention provide that the mobile shearing part 116 defines with its blade at least part of the flat surface 25. In the form of embodiment in which the shearing unit 12 can be translated in an orthogonal direction to the axis of feed D and to the direction of translation T, it is possible to control the position of the mobile shearing part 116 as a function of the diameter of the worked bar B and prevent the shearing of the shaped product. The translation of the bending unit 12 is used to take the tool below the work plane, avoiding conditions of interference with the product just made and facilitating the discharge of the latter.

Figure 5:
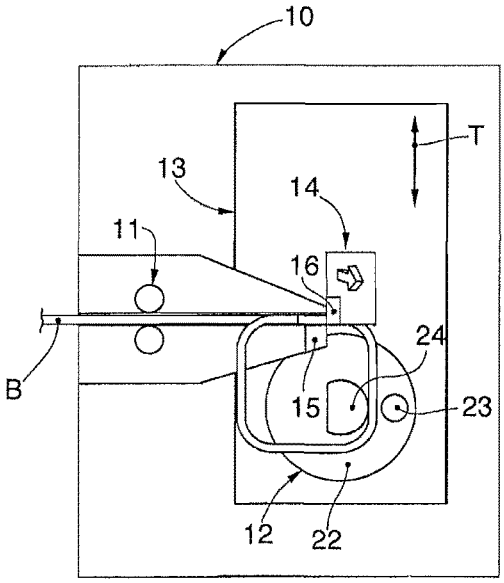
FIG. 5 is a schematic representation of the machine for bending metal products in FIG. 1, in a fourth operating condition.

Implementations of the solution shown in FIG. 5 can provide that the mobile shearing part 116 is provided with two blades, similar to what is described for the shearing blades 20*a* and 20*b*, mounted on both sides of the contrast pin 24 and suitable to cooperate with the shearing blades 19*a* and 19*b* of the fixed shearing part 15.

It is also clear that, although the present invention has been described with reference to some specific examples, a person of skill in the art shall certainly be able to achieve many other equivalent forms of machines for bending metal products and perfecting a bending method, having the characteristics as set forth in the claims and hence all coming within the field of protection defined thereby.

The invention claimed is:

1. A machine for bending metal products, the machine comprising:

a bending unit;

a drawing unit configured to feed at least one metal product along an axis of feed and toward said bending unit; and a shearing unit configured to shear said at least one metal product, said bending unit being mounted on a translating platform able to be translated in a direction of translation transverse to said axis of feed, said bending unit comprises:

a rotating mandrel, wherein said rotating mandrel is disc shaped, a bending pin disposed on a periphery of said rotating mandrel, and a contrast pin disposed at a center of rotation of said rotating mandrel, when in operation, a rotation of said rotating mandrel rotates the bending pin to bend the at least one metal product around said contrast pin, wherein at least one part of said shearing unit is mounted on said translating platform, and wherein said shearing unit comprises a fixed shearing part mounted on a component fixed with respect to said translating platform and a mobile shearing part mounted on the translating platform.

2. The machine as in claim 1, wherein said at least one part of said shearing unit is adjacent to said bending unit in said direction of translation.

3. The machine as in claim 1, wherein said fixed component extends toward said translating platform, at least partly overlapping it.

4. The machine as in claim 1, wherein said fixed shearing part comprises two shearing blades each of which is disposed on one side and the other with respect to said axis of feed, and suitable to cooperate, during use, with respective shearing blades of said mobile shearing part.

5. The machine as in claim 1, wherein said contrast pin has a sectioned cylindrical configuration so as to define a flat surface facing toward said drawing unit during use.

6. The machine as in claim 5, wherein said at least one part of said shearing unit is mounted on, or is made closely adjacent to, said contrast pin.

7. The machine as in claim 1, wherein said contrast pin has a flat surface, and said flat surface of said contrast pin can be positioned substantially flush with said fixed shearing part during the translation of said translating platform.

8. The machine as in claim 1, wherein said at least one part of said shearing unit is mounted on said bending unit.

9. A method for bending metal products, the method comprising:

feeding at least one metal product along an axis of feed to carry out at least one bending operation;

bending the at least one metal product by a bending unit mounted on a translating platform;

translating the at least one metal product by translating said translating platform in a direction of translation transverse to said axis of feed; and shearing the at least one metal product by a shearing unit, wherein said shearing unit comprises a fixed shearing part mounted on a component fixed with respect to said translating platform and a mobile shearing part mounted on the translating platform, and wherein said translating of said translating platform in said direction of translation brings at least a part of said shearing unit in cooperation with said metal product, said at least one part of said shearing unit being mounted on said translating platform, wherein said bending unit comprises:

a rotating mandrel, wherein said rotating mandrel is disc shaped, a bending pin disposed on a periphery of said rotating mandrel, and a contrast pin disposed at a center of rotation of said rotating mandrel, when in operation, a rotation of said rotating mandrel rotates the bending pin to bend the at least one metal product around said contrast pin.

10. The method as in claim 9, wherein the translating of said translating platform determines actuation of said shearing unit.

* * * * *